US009969535B2

(12) United States Patent
Lagler

(10) Patent No.: US 9,969,535 B2
(45) Date of Patent: May 15, 2018

(54) HINGED CLOSURE MOULDED IN CLOSED POSITION

(71) Applicant: Louis Lagler, Zürich (CH)

(72) Inventor: Louis Lagler, Zürich (CH)

(73) Assignee: CREANOVA AG, Zug (CH)

( * ) Notice: Subject to any disclaimer, the term of this patent is extended or adjusted under 35 U.S.C. 154(b) by 335 days.

(21) Appl. No.: 14/213,362

(22) Filed: Mar. 14, 2014

(65) Prior Publication Data

US 2014/0197189 A1 Jul. 17, 2014

Related U.S. Application Data

(63) Continuation of application No. 10/563,338, filed as application No. PCT/CH03/00491 on Jul. 18, 2003, now abandoned.

(51) Int. Cl.

| | |
|---|---|
| ***B65D 39/00*** | (2006.01) |
| ***B65D 41/00*** | (2006.01) |
| ***B65D 43/00*** | (2006.01) |
| ***B65D 47/00*** | (2006.01) |
| ***B65D 51/00*** | (2006.01) |
| ***B65D 43/14*** | (2006.01) |
| ***B65D 51/04*** | (2006.01) |
| ***B65D 41/16*** | (2006.01) |
| ***B65D 47/08*** | (2006.01) |
| ***B65D 55/16*** | (2006.01) |

(52) U.S. Cl.

CPC ..... *B65D 41/16* (2013.01); *B65D 47/0809* (2013.01); *B65D 2101/00* (2013.01)

(58) Field of Classification Search

CPC ..... B65D 41/16; B65D 47/0804; B65D 47/0809; B65D 55/16

USPC ..... 215/235, 238, 325; 220/837

See application file for complete search history.

(56) References Cited

U.S. PATENT DOCUMENTS

| | | | |
|---|---|---|---|
| 3,677,431 | A | 7/1972 | Westfall |
| 4,043,475 | A | 8/1977 | Wheeler |
| 4,854,473 | A | 8/1989 | Dubach |
| 4,913,493 | A | 4/1990 | Heidmann |
| 4,915,268 | A | 4/1990 | Lay et al. |
| 5,067,624 | A | 11/1991 | Thanisch |
| 5,148,912 | A | 9/1992 | Nozawa |
| 5,535,802 | A | 7/1996 | Chambers |
| 5,794,308 | A | 8/1998 | Rentsch et al. |
| 6,041,477 | A | 3/2000 | Rentsch et al. |
| 6,152,320 | A | 11/2000 | Hierzer et al. |
| 6,460,712 | B2 | 10/2002 | Smith et al. |
| 6,634,060 | B1 | 10/2003 | Lagler et al. |
| 6,821,239 | B2 | 11/2004 | Hierzer et al. |
| 7,469,795 | B2 | 12/2008 | Druitt et al. |
| 2002/0079282 | A1 | 6/2002 | Harrold et al. |

(Continued)

FOREIGN PATENT DOCUMENTS

| | | |
|---|---|---|
| EP | 0 309 369 A1 | 3/1989 |
| EP | 0 532 471 A1 | 3/1993 |

(Continued)

*Primary Examiner* — Andrew T Kirsch

(74) *Attorney, Agent, or Firm* — Pauley Erickson & Kottis

(57) ABSTRACT

The invention is directed to a closure moulded in closed position. The closure comprises a body and a lid, which are separated by a circumferential gap. A snap hinge comprising two trapezoid elements which are connected each by film hinges to the body and the lid, causes a snap action while opening or closing the closure. The closure offers opening angles in the range of 220°.

11 Claims, 4 Drawing Sheets

(56) References Cited

U.S. PATENT DOCUMENTS

| | | | |
|---|---|---|---|
| 2003/0205549 | A1 | 11/2003 | Harrold et al. |
| 2006/0163188 | A1 | 7/2006 | Lagler |

FOREIGN PATENT DOCUMENTS

| | | | |
|---|---|---|---|
| EP | 0 685 406 | A1 | 12/1995 |
| EP | 0 746 512 | | 12/1996 |
| EP | 0 836 576 | A1 | 4/1998 |
| EP | 1 075 432 | A1 | 2/2001 |
| EP | 1 147 054 | A1 | 10/2001 |
| EP | 1 582 475 | A1 | 10/2005 |
| FR | 2 715 381 | | 7/1995 |
| JP | 60-107686 | | 6/1985 |
| JP | 62-200269 | | 9/1987 |
| JP | 05-041290 | | 2/1993 |
| JP | 11-043168 | | 2/1999 |
| JP | 11-050822 | | 2/1999 |
| WO | WO 95/23097 | | 8/1995 |
| WO | WO 97/02189 | | 1/1997 |
| WO | WO 99/57029 | | 11/1999 |
| WO | WO 00/44638 | | 8/2000 |
| WO | WO 00/44639 | | 8/2000 |
| WO | WO 02/32775 | A1 | 4/2002 |

HINGED CLOSURE MOULDED IN CLOSED POSITION

This application is a continuation application of U.S. application Ser. No. 10/563,338, filed 3 Jan. 2006, which is a 35 U.S.C. § 371 national phase of international application PCT/CH2003/000491, filed 18 Jul. 2003. The subject matter of these earlier filed applications is hereby incorporated by reference.

BACKGROUND OF THE INVENTION

Field of the Invention

The present invention is directed to a hinged closure moulded in closed position and a container suitable to be used with the hinged closure according to the preamble of the independent claim.

Discussion of Related Art

From the state of the art screw caps e.g. drinking bottles made of polyethylene (PET) and bottles made of glass are known. One disadvantage of these closures is that a lot of physical strength is necessary to open and to close them. Besides this, the known screw cap closures are in general difficult to mould due to the thread on the inside which often causes problems in demoulding. A further disadvantage is that the screw caps cannot be operated single handed and after opening the cap has to be held separately.

From EP 1 147 054 a hinged closure with a hinge moulded in closed position is known. Although this closure shows significant improvements over the closures known from the state of the art, due to the arrangement of the hinge, the lid cannot be moved completely out and away from the orifice as it would be desired while drinking directly out of a bottle. The hinge of such a closure is arranged at an angle with respect to the main axis of the closure such that the hinges, made of thin plastic films, are accessible in the mould from above and from below.

EP 0 532 471 shows a hinged closure moulded in a closed position. The conventional type of hinge incorporated in this closure has a single band of plastic which forms a direct connection between the lower part, the body, and the upper part, the lid. Particularly due to the main hinge connection the lid cannot be moved out and away from the orifice such that drinking from the bottle is not possible. This type of closures was therefore never used for drinking bottles. The only known application is a niche product on a bottle for cooking oil in France.

From EP 0 309 369 a plastic closure having a lower part (body) and an upper part (lid) is known, that can be produced in a closed condition. The upper part is connected to the lower part by a main film hinge connection such that the upper part moves on a circular path with respect to the lower part. The upper part has, on its inner side, an extending portion with projecting sealing elements which form, with the outlet of a container, a sealing connection. The upper part is additionally connected with the lower part in a pivoting manner by a spring element. The spring element is connected with the upper part by a film hinge, and connected with the lower part by a film hinge. For purposes of opening, the film hinge connecting the upper part and the lower part is bent. Due to the small opening angle and the disadvantages of a main hinge connection between the closure parts this closure concept is not suitable e.g. for beverage containers.

A further closure moulded in closed position is known from FR 2 715 381 . This closure does have a dead hinge without snap action which is based on two plastic bands which are twisted while opening or closing of the closure. The mould utilization factor is relatively low due to the large diameter of the closure. A further disadvantage is the small opening angle.

Closures for drinking bottles are products which are extremely under pricing pressure. The price is mainly determined by the material used per closure, the cycle time for manufacturing and the mould utilization factor, which is mainly determined by the space which a closure requires in a mould. In general hinged closures are manufactured in an open position, requiring therefore more space than closures which are injection moulded in a closed position. The mould utilization factor of a closed moulded closure is mainly determined by the base area, respectively the diameter. A closure with a vertically arranged side wall does therefore have a better mould utilization factor than a closure with an inclined side wall. Best mould utilization factors are achieved with closures having cylindrical side walls.

SUMMARY OF THE INVENTION

It is an object of the present invention to provide a hinged closure moulded in closed position with a large opening angle and an optimized mould utilization factor.

It is a further object of the present invention to provide a hinged closure suitable to replace conventional screw cap type closures of bottles for still and/or carbonized beverages.

Hinged closures moulded in a closed position in general comprise a ring shaped lower part (body) and a cap like upper part (lid) which is connected by a hinge to the lower part. The cap like upper part in general does incorporate a built in sealing device and/or a separate sealing mean. The ring like lower part in general does comprise holding means which are suitable to fix the closure on a corresponding neck of a bottle. The lower and the upper part of the closure are connected by a hinge structure and may be connected directly or indirectly by further means such as locking means or means which are indicating tamper evidence or initial opening. The hinge structure may be living, with snap effect, or dead, without snap effect. If appropriate the parts of the closure are additionally equipped with tamper evidence means, e.g. a tear-off band or thin material bridges, which are removed or destroyed, indicating initial opening of the package.

To optimize the mould utilization factor closures having a cylindrical or straight side wall are preferred. This aspect has to be considered in mould design, because closures having a cylindrical side wall often have undercuts which are difficult to demould. A mould cavity for a closure in general comprises a core defining the inner shape of a closure and at least two mould halves forming the outer shape of the closure. Further elements, such as stripping-rings may be necessary to demould the closure or to remove the closure from the core.

A large opening angle, which guaranties that in open position the lid is sufficiently far away from the orifice is not achievable by conventional type of hinges, having a main hinge connection which connects the body and the lid directly, due to the reason that the opening angle of these conventional hinges is in the range of 130° only. The hinge of a closure according to the present invention does not have a main hinge connection between the closure parts, such that the opening angle $\alpha$ may be in the range of 200° to 240°. The definition of the angles are described in EP 0 836 576 . This application is hereby incorporated in the present description with respect to the definition of the angles $\alpha$, $\omega$ and $\varphi$ (see below).

To solve the above mentioned problems several moulding related aspects have to be considered in the design of the closures. For technical and economic reasons it is foreseen that the hinged closure preferably can be stripped from the core. Good results are obtained by a stripping-ring which is moved along the surface of the core of the mould which forms the inside of the closure. To prevent collision between the stripping-ring and the hinge it is important that especially the hinge is designed in a way that it does not protrude over the main radius (diameter) of the core on the inside of the closure. Due to the reason that conventional type of hinges neither do offer a large opening angle nor do offer the capability to be designed in a way such that no collision occurs, the present invention comprises a special type of hinge which is designed such that all needs may be satisfied.

The hinge of the closure comprises two trapezoid elements which are forming a coordinated double hinge mechanism providing an appropriate kinematical behavior of the closure parts with respect to each other while opening and closing the closure. The kinematical concepts of the double hinge mechanism guarantees that the closure parts are not moving on circular paths with respect to each other, which is in general necessary to ensure appropriate functionality. Conventional hinge concepts, which are submitted to the restrictions of a main hinge connection between the lid and the body of the closure, are not appropriate to solve the above mentioned problems. Further disadvantages of conventional hinges are the restricted opening angle in the range of 130° and the large stress in the material often causing hinge failure.

The trapezoid elements are preferably arranged substantially vertical (parallel to the side walls of the closure) with respect to the base plane of the closure. Each of the trapezoid elements is connected by a film hinge (thin web of plastic, defining a clear hinge action) to the body and the lid of the closure. The two film hinges adjoining the first and the second trapezoid element are arranged in a first and in a second plane. The film hinges of the first and the second plane are, with respect to each other intersecting at an angle $\varphi$. The first and the second plane, with respect to each other, are intersecting at an angle $\omega$. The first and the second plane are preferably arranged parallel to the axis of the closure/core, respectively to the strip-off direction. The two free edges of each trapezoid, element which are not connected by film hinges to the lid or the body of the closure, are in general free such that they do not hinder the movement of the closure parts while opening or closing the closure. Due to the trapezoidal shape of the trapezoid elements one of the two free edges is longer than the other. In general the longer free edge always remains free, in specific embodiments the shorter free edges of the trapezoid elements may be connected directly or indirectly by at least one film hinge and/or an intermediate part to each other.

The trapezoid elements are preferably built with a certain torsional stiffness such that they do not twist under along their length under torsional load/moment which occurs while opening or closing of the closure. Optimized value of torsional stiffness depends on the size of the closure and the hinge. In general torsional stiffness should be high enough that the closure parts are coordinated with respect to each other while opening and closing of the closure. The trapezoid elements are preferably built sufficiently stiff such that the do not collapse under pressure load acting in the direction of their length axis.

Several sealing concepts to seal the orifice of the container are applicable depending on the field of application. In contrary to this conventional hinges known from the state of the art are limiting the scope due to their kinematics. Preferred sealing means are in general surrounding the upper rim of the neck of the orifice and/or are at least reaching partly into the orifice, working as a plug from the inside. Due to the reason that these sealing concepts in general demand that the sealing mean moves at least approximately in the longitudinal direction of the opening while opening and closing of the closure, hinge concepts having a main hinge connection between the lid and the body are difficult to apply. Hinges having a main hinge connection between the body and the lid are not applicable because of the main hinge connection the lid is moving on a circular path around the main hinge connection. If such a hinge-concept with a main hinge should be applied it would be necessary to arrange the main hinge connection on the level of the upper rim of the orifice, because otherwise it would not be possible to place the seal properly with respect to the orifice. Therefore it is evident that the applied hinge does not restricting the functionality of the sealing mean or is adoptable to it.

By contrast to conventional hinges, the herein foreseen hinge mechanism is preferably an improved multi-hinge mechanism as described in EP 0 746 512, EP 0 836 576 and EP 1 075 432 and which does not have a main hinge connection between the closure parts. The restrictions inherent to the hinges known from the state of the art do not apply.

At presence no hinged closures are available for drinking bottles for carbonized beverages subjected to increased internal pressure. Specific embodiments of the herein disclosed invention offer the opportunity to provide a closure which is sealed at increased pressure and which is provided with a latching mechanism offering the opportunity to lock the closure repeatedly pressure tight. The latching mechanism is preferably equipped with a tamper evidence mean to prevent unforeseen and indicate initial opening of the packaging. A preferred tamper evidence mean is at least one thin moulded bridge connecting the lid and the body directly or indirectly. This bridge is made such that it is destroyed while first opening.

BRIEF DESCRIPTION OF THE DRAWINGS

The herein described invention will be more fully understood from the detailed description of the given herein below and the accompanying drawings which should not be considered limiting to the invention described in the appended claims.

DESCRIPTION OF PREFERRED EMBODIMENTS

A better understanding of the present invention may be obtained by the present detailed description which, when examined in connection the accompanying drawings sets forth preferred embodiments of the inventions described herein. It should be understood that corresponding elements in the various figures are generally identified with corresponding reference numbers.

Figure 1:
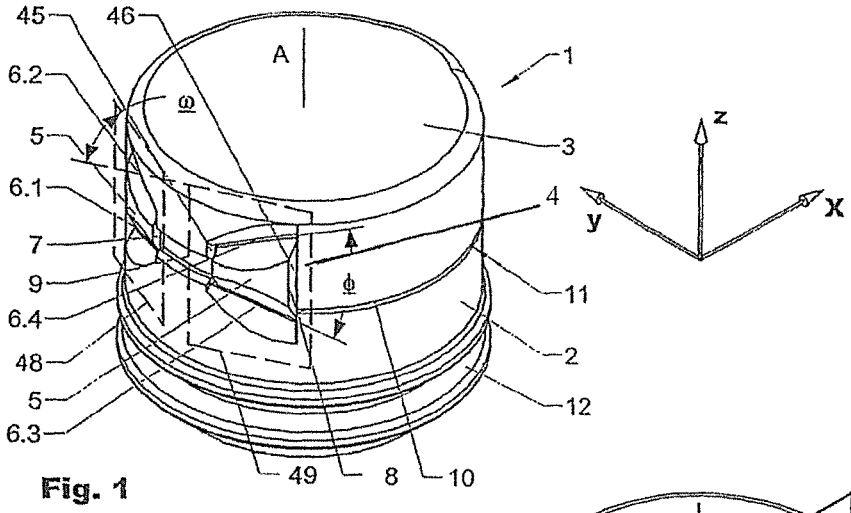
FIG. 1 shows in a perspective rear view a hinged closure.

FIG. 1 illustrates a hinged closure 1 according to the present invention moulded in closed position in a perspective view from the back. The closure 1 comprises a ring shaped lower part 2 (body) and a cap like upper part 3 (lid) which are interconnected by a snap hinge 4. In contrast to most of the hinges known from the state of the art the snap hinge 4 does not have a main hinge connection between the body 2 and the lid 3. The snap hinge 4 comprises a first and a second trapezoid element 5, of which each is connected to the body 2 and the lid 3 by a first and a second film hinge element 6.1, 6.2, respectively 6J, 6.4. The hinge elements 6.1, 6.2, 63, 6.4 (abbreviation 6) are embodied as film hinges having a clear hinge action defined by a thin web of material aligned due to injection moulding. The preferred thickness of the film hinges is in the range of 0.2 to 0.6 mm, depending on the size of the closure. Each of the trapezoid elements 5 has a shorter and a longer free edge 7, 8, which are delimited to the body 2 and the lid 3 by a first shorter and a second longer gap 45, 46 which are arranged in the present embodiment substantially vertical and in x-direction such that they can easily be demoulded. The trapezoid elements 5 are spaced apart separated by a cutout 9. In certain embodiments the intermediate elements 5 may be connected to each other along their shorter free edge 7 directly or indirectly by at least one additional film hinge (not visible in this embodiment). Such connection may result in a weaker hinge and/or delimiting of the opening angle.

The film hinges 6 of each trapezoid element 5 are defining a first and a second plane 48, 49, which are intersecting at an angle ω to each other. The definition of the angles are described in EP 0 836 576. This application is hereby incorporated in the present description with respect to the definition of the angles α, ω and φ.

The body 2 and the lid 3 are separated by a circumferential gap 10. In the gap 10 thin bridges 11 of plastic material may be arranged. These bridges are designed such that they are preventing collapsing of the closure while demoulding due to strip of forces. Simultaneously the bridges 11 are acting as tamper evidence elements which are destroyed while initial opening indicating initial opening of the closure. Good results are obtained when the bridges are having a pyramidal shape.

Supplementary or in replacement of the bridges 11 a tear off band (not displayed) may be incorporated which is removed before initial opening.

The closure 1 is arranged on the neck of a bottle 12 which is only partially visible. The orifice of the bottle 12 is arranged in the lid 3 (not visible), sealed off in closed position by a sealing mean. The body 2 is fixed on the neck of the bottle 12, in general by press on. On the inside the body 2 does have holding means (not visible) which are suitable to be engaged with corresponding elements on the neck of the bottle 12 guarantying secure fixation of the closure 1. Axis A of closure 1 is arranged parallel to z-Axis of the global coordinate system. Angle φ is the angle between the film hinges 6 adjoining the trapezoid element 5. The film hinges 6 (6.1, 6J, respectively 6J, 6.4) of each trapezoid element 5 may not be arranged parallel due to lack of functionality.

Figure 2:
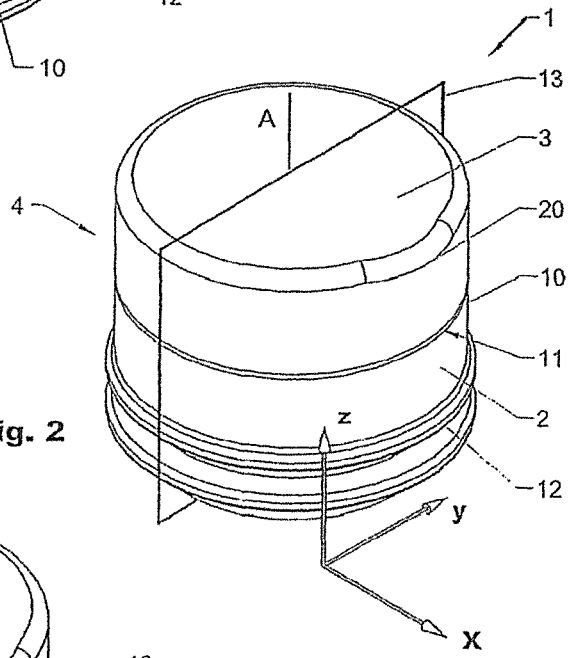
FIG. 2 shows in a perspective front view a hinged closure.

FIG. 2 is showing an embodiment of a closure 1 moulded in closed position in a perspective front view. The hinge 4 of the closure 1 is not visible because it is arranged on the rear side of the closure 1. On the front of the closure 1 a finger recess 20 is visible arranged at the upper rim of lid 3. The lid 3 of the closure 1 comprises on the inside nearby to the circumferential gap 10 first elements (not visible) protruding radially inward which are in closed position of the closure engaged with corresponding second elements (not visible) of the neck of the bottle 12. The first and the second elements are preventing unforeseen opening of the closure. The shown closure 1 is mainly designed for still water/beverages (non-carbonized water/beverages) without internal pressure.

Due to the undercuts often necessary in the area of the trapezoidal elements 5, the cutout 9 and the circumferential gap 10, the mould (not visible) used to make the closure 1 in general comprises preferably two parts on the outside, whereby the parting plane of the mould, indicated by line 13, is arranged parallel to the closure axis A (yz-plane of shown coordinate system) and perpendicular to the snap hinge 4. The inside of closure 1 is preferably formed by a single core.

Figure 3:
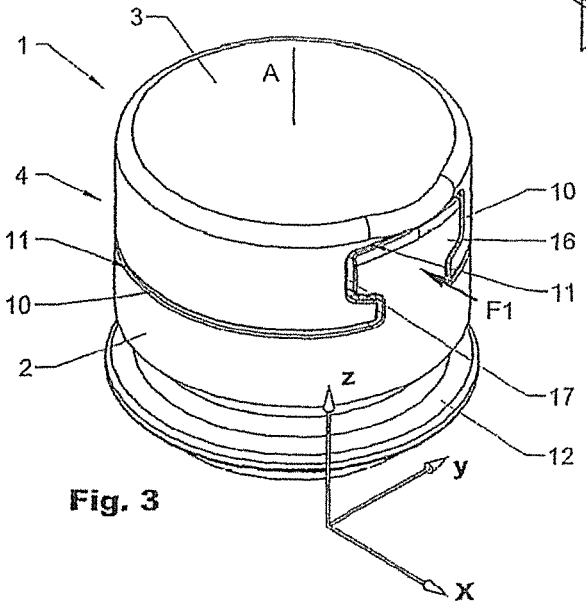
FIG. 3 shows in a perspective front view a second embodiment of a hinged closure with a latching mechanism.

FIG. 3 is showing a further embodiment of the closure 1 in a perspective front view on the neck of a bottle 12. The hinge 4 is on the back of the closure 1 and therefore not visible in detail. Opposite to the snap hinge 4 a latching mechanism 15 is incorporated which prevents unforeseen opening of the closure 1. The latching mechanism 15 comprises a latch 16 which is part of the body 2. In the closed position of the closure the latch 16 is engaged with a corresponding notch 17. The latch 16 which is arranged movably in radial direction in the outer side wall of the lid 3 comprises a neck 18 and a head 19 which is wider than the neck 18 forming in the closed position a tangentially undercut with the notch 17 preventing unforeseen opening of the closure. The circumferential gap 10 does surround the latch 16 and the notch 17. To open the closure the latch 16 is pressed inside in the direction of arrow FI versus the neck of the bottle 12 until the head 19 of the latch 16 releases the notch 17 and the lid 3 can be opened. The latch 16 is preferably formed such that while closing the lid 3 the latch 16 is moved automatically away outside or inside such that the lid 3 and the notch 17 may pass. To prevent collision, the upper edge of the latch 16 preferably is formed round or inclined. In the circumferential gap 10 tamper evidence features, such as bridges 11 may be arranged to indicate initial opening. The shown closure 1 is mainly designed for carbonized water/beverages causing an increased internal pressure in the bottle.

Figure 4:
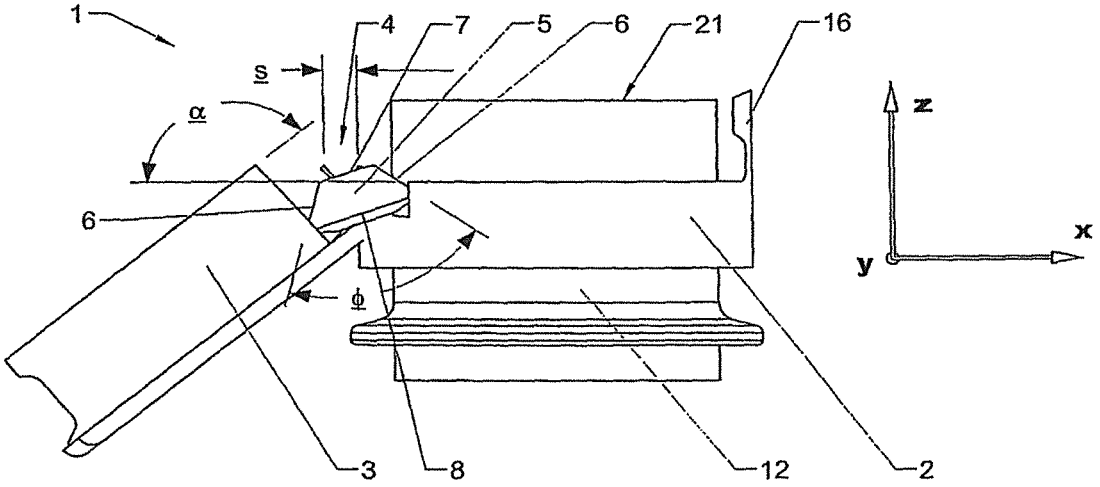
FIG. 4 shows the hinged closure according to FIG. 3 in a side view.

FIG. 4 is showing the closure 1 according to FIG. 2 in a side view in open position. The snap hinge 4 is designed such that the opening angle α (angle between the closed and the open position) is in the range of 220°. This guarantees that drinking from an orifice 21 of the bottle 12 is not hindered by the lid 3. As it can be seen the trapezoid elements 5 are arranged in an inverse position at a position corresponding approximately to half of the opening angle α. Closure 1 is designed such that the parts and elements of closure 1 are in the closed and in the open position stress free. In-between the open and the closed position, snap hinge 4 causes deformation of the parts of snap hinge 4 and the other parts of closure 1 and/or bottle 12. This deformation is depending on the design of the closure stored as elastic energy in certain areas of the lid 3 and/or the body 2 and/or the trapezoid 5 elements and/or the film hinges 6 causing the snap action of lid 3 versus body 2. While opening or closing closure 1 lid 3 has to be moved against a resilient force and after passing of a dead center position (instable) lid 3 moves automatically into the nearest open or closed position. The angle φ between the film hinges 6 of a trapezoid element is one parameter which takes influence on the snap effect of closure 1. The relation between the different angles of a snap hinge 4 is explained in FIG. 5. In the open position the body 2 and the lid 3 are spaced a distance s apart. Due to this it is possible to achieve an opening angle ω which is beyond 180°. Depending on the size of the closure the distance s is in general 50% to 90% of the shorter edge 7 of trapezoid elements 5.

Figure 5:
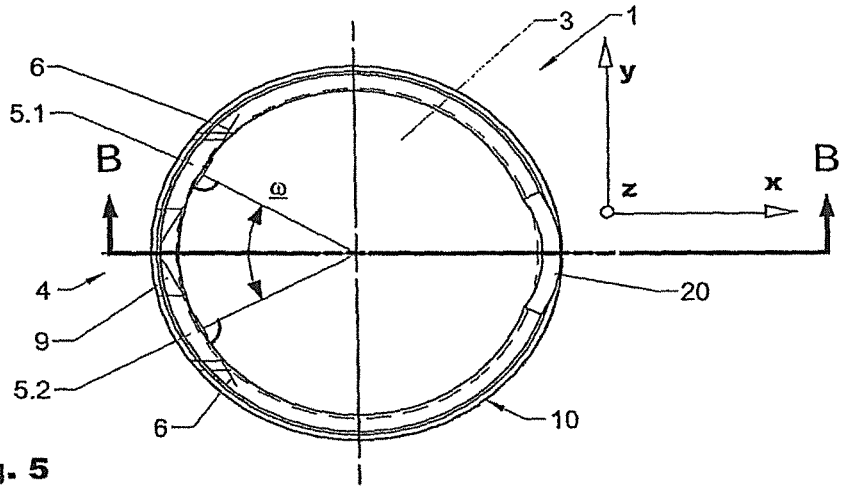
FIG. 5 shows a hinged closure and a bottle in a top view.

FIG. 5 is showing a closed closure 1 in a top view. The snap hinge 4 is arranged on the left hand side of the drawing and the finger recess 20 on the right hand side. The trapezoid elements 5 which are arranged parallel to the cylindrical side wall 22 of the closure 1 are displayed in a top view. The axis of the hinge elements (film hinges) 6 are indicated by a dot-dash line. The angle ω between the normal on the ground projection (xy-plane) of the axis of the film hinges 6 is an important factor for calculating of the snap action of the hinge and the opening angle. The relation between the opening angle α of the closure 1 the angle ω and the angle φ between two film hinges 6 of each trapezoid elements 5 is as follows:

$$\Phi/2 = \alpha\tan\left[\frac{\sin(\alpha)}{1-\cos(\alpha)}\sin\left(\frac{\varpi}{2}\right)\right]$$

Figure 6:
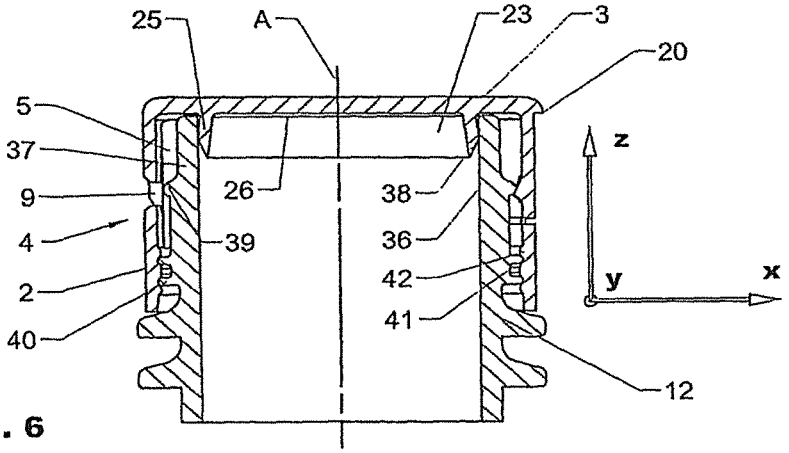
FIG. 6 shows a cut through the closure and the bottle according to FIG. 5 in a plane view.

The cross cut along line BB is displayed in FIG. 6.

FIG. 6 is showing a cross cut along line BB of FIG. 5. A sealing element 23 is arranged on the inside of lid 3. The sealing element 23 is in the closed position of the closure engaged with the neck 24 of the bottle 12. The sealing element 23 has a protruding rim 25 which is formed out on the inside of the horizontal (xy-plane) base 26 of the lid 3. The protruding rim 25 has in the shown embodiment a slightly conical shape divergent from ground 26 of lid 3. The largest diameter of rim 25 is in the contact area 38 with the inside surface 36 of orifice 37. Rim 25 is designed such that in the closed position of the closure 1 it is engaged with the neck 24 exposed to a certain radial compression, sealing of orifice 37 of bottle 12. Neck 18 of bottle 12 has on its outside on the level of lid 3 a radially protruding circumferential holding rim 39. In the closed position of lid 3 the holding rim 39 engages with a radially inwardly protruding holding element 29 formed out on the inside of lid 2 avoiding unintentional opening of closure 1.

Neck 18 of bottle 12 comprises a fixing mean built out in the shown embodiment as radially protruding fixing rims 40. Closure 1 comprises circumferential recesses 41, arranged between three corresponding radial flanges 42, which are cooperating with the fixing rims 40 of bottle 12, serving as holding means on the inside of closure 1. Alternative means to securely fix closure 1 on the neck 18 of bottle 12 are applicable. The fixing mean of closure 1 may be preferably built such that it can be demoulded by force. To reduce demoulding forces (circumferential) the radial flanges 42 may be segmented.

Figure 7:
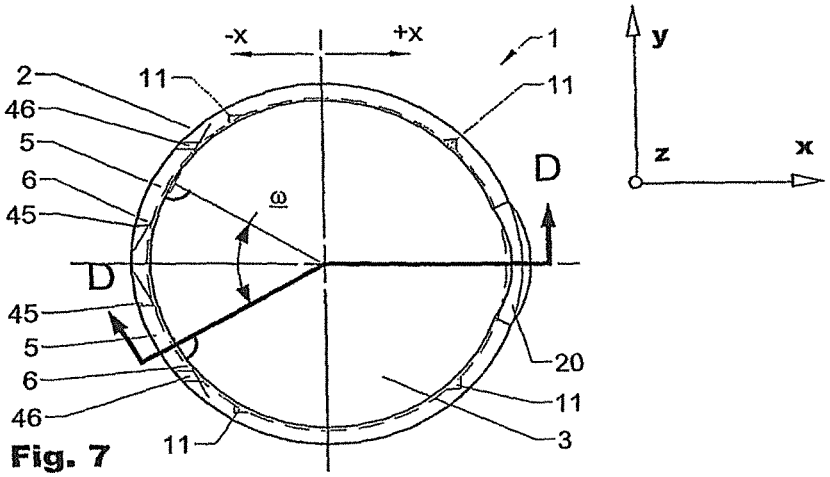
FIG. 7 shows a hinged in a top view.

FIG. 7 is showing a top view of a closure 1. Line DD illustrates the cut as displayed in FIG. 8. Line DD is arranged through the middle of a trapezoid element 5 and the adjoining film hinges 6 of the snap hinge 4. The trapezoid elements 5, the film hinges 6, the cutout 9 and the circumferential gap 10, such as the bridges 11 and vertical first and second gaps 45, 46 are made such that they can be demoulded by opening the outer section of the mould (not visible) in +x and in −x direction. Therefore the trapezoid elements 5, the film hinges 6 and the bridges 11 are preferably arranged along the inner wall 28 of the closure 1 such that no hindering overlapping exists in x-direction. The circumferential gap 10 and the vertical first and second vertical gap 45, 46 may be, if required, delimited by non-parallel side walls, e.g. conical.

Figure 8:
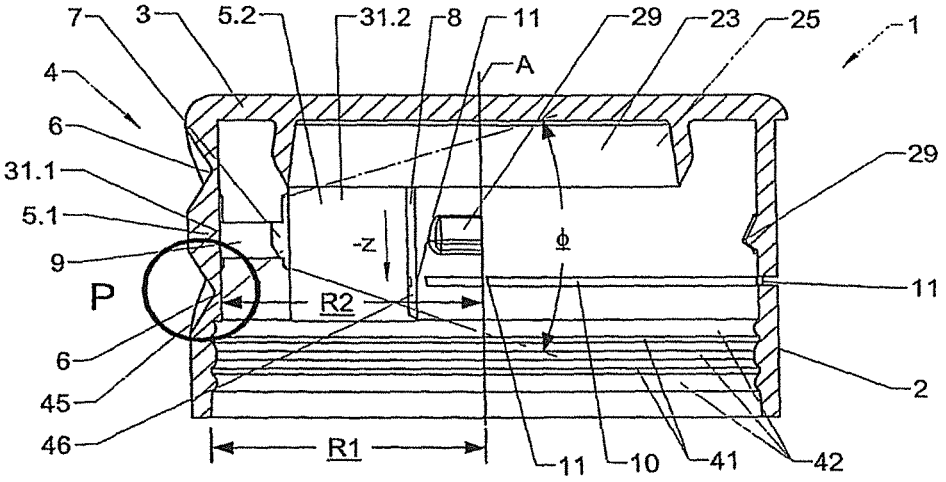
FIG. 8 shows the closure according to FIG. 7 in a sectional view along line DD.

FIG. 8 is showing the cut along line DD according to FIG. 7. The cut runs through a trapezoid element 5 and the two adjoining hinge elements 6, the sealing element 23 and a radially inwardly protruding holding element 29 which is arranged near the circumferential gap 10. In the circumferential gap 10 bridges 11 are visible which are acting as tamper evidence means which are de-strayed while initial opening.

The film hinges 6 and the trapezoid elements 5.1, 5.2 (abbreviation 5) are designed on the inside of the closure 1 such that they can easily be demoulded in −z direction by stripping the closure 1 of a core of the mould (both not visible). As visible in this embodiment, the film hinges 6 are formed straight for optimized hinge performance. The inner periphery of this closure 1 is designed here as a flat plane 31 being arranged at a radius R2 which is smaller then the main inner radius R1 of the closure 1. In this view one flat plane 5.1 of one trapezoid element is perpendicular to the drawing plane and therefore only visible as a line. The flat plane 31 J of the opposite trapezoid element 5.2 is fully visible.

All elements on the inside of the closure 1 are arranged on a smaller radius than the main inner radius R1, because otherwise it would be difficult to demould the closure 1 by a stripper-ring having an inner radius corresponding to R1. The snap hinge 4 is preferably designed that it does not form any undercut which has to be demoulded by force. The inner periphery of the film hinges 6 is arranged as a secant to a circle having a radius R1 equal to the main inner radius R1 of the closure 1.

Figure 9:
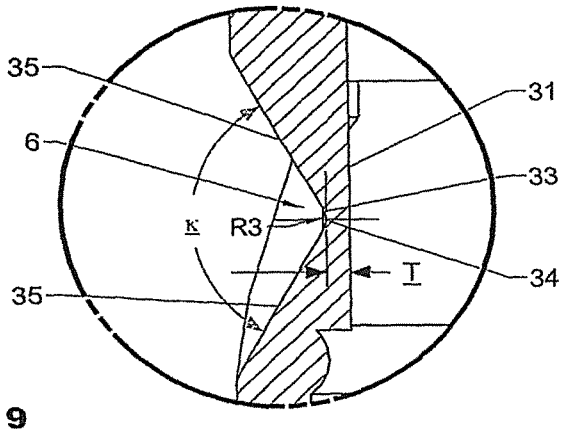
FIG. 9 shows a detail P of FIG. 8.

FIG. 9 is showing detail P of FIG. 8 in a magnified manner.

FIG. 9 is showing detail P of FIG. 8 in a magnified manner. The film hinges 6 are preferably designed in a way that they are straight over there entire length. The periphery of the film hinge 6 is on the outside of the closure 1 formed by two straight (flat) boundary planes 35 and a cylindrical boundary surface 33 connecting the two boundary surfaces 35 tangentially having a radius R3. The two boundary surfaces 35 are arranged at an angle K to each other. While opening the closure 1, film hinge 6 hinges around a hinge axis 34. During opening of closure 1 the two boundary planes 35 are moved together until they reach closest position in fully open stage of the closure 1. Angle K is designed such that the closure can be opened without collision of the two boundary planes 35 such that no hindering occurs. For best performance the hinge is designed in a way that the (theoretical) hinge axis 34 of the film hinges 6 is aligned tangentially to the cylindrical boundary surface 33. The thickness T of the film hinges 6 is, depending on the size of the closure, preferably in the range of 0.2 mm to 0.6 mm. The film hinges 6 are formed such that the closure can be completely opened without collision of blocking of the movement. Alternative embodiments of film hinges, having a different cross-section may be incorporated.

Figure 10:
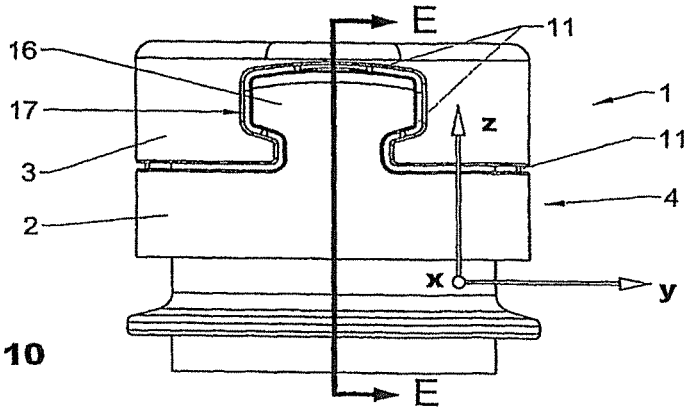
FIG. 10 shows the closure from FIG. 3 in a side view.

FIG. 10 is showing the closure 1 according to FIG. 3 in closed position from the front. In the circumferential gap 10 bridges 11 are visible. Latch 16 is arranged in notch 17 preventing unintentional opening of lid 3. Due to the reason that bridges 11, which are serving as tamper evidence means, are still connecting body 2 and lid 3 it becomes clear that the closure 1 never was opened. Snap hinge 4, which is arranged on the back of closure 1, is not visible in detail. Line FF illustrates the cut displayed in FIG. 11.

Figure 11:
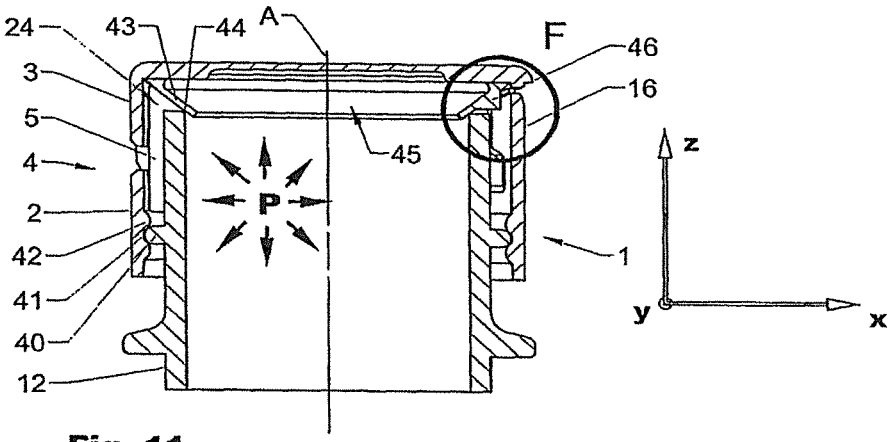
FIG. 11 shows the closure according to FIG. 10 in a sectional view along line EE.

FIG. 11 is showing a cross cut through the closure 1 of FIG. 10 along line EE. The closure 1 is arranged on the neck 24 of the bottle 12. The body of closure 1 is hold by radial fixing rim 40 of the bottle 12 which is engaged with the circumferential recess 41 of the closure 1. The hinge 4 is visible only partially. Behind the neck 24 of the bottle 12 an inner surface of trapezoid element 5 is visible. On the inside of lid 3 a sealing device 43 is visible having a conical rim-like shape which is directed inwardly with respect to the orifice 37 of neck 24. The sealing device 43 is centered on axis A of closure 1 and with respect to neck 24 of bottle 12. The sealing device is fixedly connected to the lid 3 and rests in closed position of the lid 3 on rim 44 of the orifice 37. The sealing device 43 of the herein shown embodiment is made of a different material which is more elastic than the material of the closure 1 and the neck 24 of the bottle 12. In certain embodiments it is possible to use the same material. The sealing device 43 is having a chamber 45 on the inside which is exposed to internal pressure P of the bottle 12. The sealing device 43 is built such that the when the chamber 45 is exposed to internal pressure P the sealing device 45 is deformed. The deformation due to internal pressure P is restricted by the rim 44 of the orifice 37 which results in that the sealing effect of the sealing device increases. A detailed description of the principle of functionality of the sealing device 43 can be retrieved from WO 0 232 775 . The sealing device 43 shown in this embodiment has a nipple 46 arranged on the outer surface versus the latch 16 having approximately the width of the nipple 46. Detail F is displayed in FIG. 12.

Figure 12:
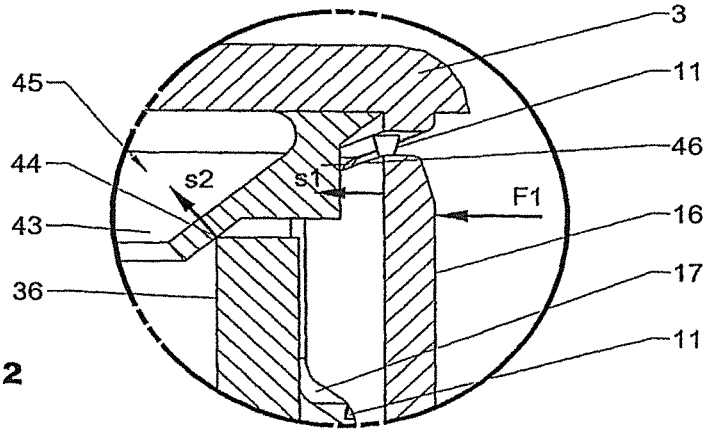
FIG. 12 shows a detail F of FIG. 11.

FIG. 12 is showing detail F of FIG. 11. The nipple 46 is designed such that when pressing the latch 16 by force FI (see FIG. 12) radially inwardly (deformation indicated by arrow s1) the latch 16 contacts the nipple 46 causing local deformation of the sealing device 43. By this deformation the sealing device 43 is locally disengaged (indicated by arrow s2) from the upper rim 44 of the orifice 37 such that controlled release of the internal pressure P occurs. After releasing pressure P latch 16 is pressed further radially inwardly until latch 16 disengages notch 17 and the lid 3 may be opened. The bridges 11 are designed such that they are destroyed when latch 16 is pressed radially inwardly indicating initial opening of the closure 1.

The invention claimed is:

1. A closure moulded in closed position with a body comprising fixing means to fix the closure on a neck of a bottle, and a lid, the lid comprising a sealing means to seal an orifice of the bottle, whereby the body and the lid are separated from each other by a circumferential gap and at least one of the body and the lid form a closure wall, the closure further comprising:

a snap hinge comprising a first and a second trapezoid element that are spaced apart from each other, and a first and second pair of film hinges, each pair defining a first and second plane, respectively, the first and second pair of film hinges connecting the first and second trapezoid elements to the lid and the body, where the first and second plane are arranged substantially parallel to an axis A of the closure when the closure is in the closed position, wherein the film hinges are positioned along an inside of the closure wall, an inside of the film hinges is configured such that the film hinges are easily demoulded in a z-direction, which is a direction of the axis A of the closure, and an inner periphery of the film hinges is arranged along a secant to a circle having a radius equal to a maximum inner radius (R1) of the closure.

2. The closure according to claim 1 wherein the first and second pair of film hinges are arranged at an angle Φ to each other, and the first and second plane defined by the first and second pair of film hinges are arranged at an angle ω, the angle Φ and an opening angle α of the closure is:

$$\phi = 2 * \arctan\left[\frac{\sin(\alpha/2)}{1-\cos(\alpha/2)} * \sin(\omega/2)\right].$$

3. The closure according to claim 1, wherein the opening angle α is in the range of 180° and 240°.

4. The closure according to claim 1, wherein the trapezoid elements are separated by a cutout.

5. The closure according to claim 1, wherein the trapezoid elements are connected by a film hinge along a shorter edge.

6. The closure according to claim 1, wherein the body and the lid are connected by tamper evidence means, which are destroyed by initial opening.

7. The closure according to claim 1, wherein the body and the lid are in the open position spaced a distance s apart, whereby, the distance s is equal to 50% to 90% of the shorter edge of trapezoid elements.

8. The closure according to claim 1, wherein said closure is characterized by a cylindrical outer wall section.

9. The closure according to claim 1, wherein the first and the second trapezoid elements, and the first and second pair of film hinges are arranged along the inner wall of the closure, wherein the inner wall is formed by the body and the lid, such that no overlapping exists in an x-direction to allow easy demoulding after moulding is complete by releasing one of two mould halves on an outer side in the x-direction and at the same time releasing the other one of the mould halves to the other side in the x-direction, whereby the x-direction is vertical to the z-direction and also vertical to the direction in which the first and the second trapezoid elements are spaced apart from each other.

10. The closure according to claim 1, wherein the inner periphery of the hinges is configured such that they do not protrude beyond a maximum inner radius (R1) of the closure.

11. The closure according to claim 1, wherein the film hinges are each defined by a plane on the inside of the closure and the outside of the film hinges are each defined by two flat boundary planes, arranged at an angle κ to each other, and a cylindrical boundary surface having a radius (R3).

* * * * *